US007340911B2

(12) United States Patent
Ha et al.

(10) Patent No.: US 7,340,911 B2
(45) Date of Patent: Mar. 11, 2008

(54) MONOLITHIC AIR CONDITIONER

(75) Inventors: Jong Min Ha, Gyeongsangnam-do (KR); Seong Kyu Min, Changwon-si (KR); Tai Hoon Kim, Woolsan-si (KR); Won Suk Jang, Pusan-si (KR); Byeong gi Kim, Changwon-si (KR)

(73) Assignee: LG Electronics Inc. (KR)

( * ) Notice: Subject to any disclaimer, the term of this patent is extended or adjusted under 35 U.S.C. 154(b) by 190 days.

(21) Appl. No.: 11/208,516

(22) Filed: Aug. 23, 2005

(65) Prior Publication Data

US 2007/0044496 A1 Mar. 1, 2007

(51) Int. Cl.
*F25D 23/12* (2006.01)
*F25D 19/00* (2006.01)

(52) U.S. Cl. ..... 62/262; 62/298

(58) Field of Classification Search ..... 62/77, 62/259.1, 262, 291, 298, 429; 165/59; 454/201, 454/213, 204; 415/204
See application file for complete search history.

(56) References Cited

U.S. PATENT DOCUMENTS 5,125,239 A * 6/1992 Kobayashi et al. ..... 62/262
5,203,400 A * 4/1993 Tsunekawa et al. ..... 165/59
5,943,873 A * 8/1999 Chung ..... 62/262
6,032,479 A * 3/2000 Choi et al. ..... 62/262
6,318,104 B1 * 11/2001 Moraes et al. ..... 62/262
6,412,298 B2 * 7/2002 Kang et al. ..... 62/262
6,604,375 B2 * 8/2003 Kim ..... 62/262

FOREIGN PATENT DOCUMENTS

JP 52-090964 A 7/1977
JP 2002-115866 A * 4/2002
KR 10-2000-0055580 A 9/2000
KR 10-2002-0009659 A 2/2002
KR 10-2002-0059935 A 7/2002

* cited by examiner

*Primary Examiner*—Mohammad M. Ali
(74) *Attorney, Agent, or Firm*—Birch, Stewart, Kolasch & Birch, LLP

(57) ABSTRACT

In a monolithic air conditioner, a front panel is mounted on a front of a cabinet and includes an indoor air intake, an indoor air outlet, and a discharge guide backwardly extended from the indoor air outlet. An indoor heat exchanger is mounted on a back of the front panel. An air guide on which the indoor heat exchanger is mounted includes an orifice in a center to pass sucked indoor air therethrough. A scroll is mounted on a back of the air guide to guide the sucked indoor air. An indoor fan is mounted between the scroll and the air guide to suck the indoor air. A shroud is mounted on a back of the scroll to guide sucked outdoor air and it defines an orifice in a center to discharge the sucked outdoor air. An outdoor fan is mounted on a back of the shroud to suck the outdoor air, a fan motor is mounted on the scroll to drive the indoor and outdoor fans, and an outdoor heat exchanger is mounted on a back of the outdoor fan to exchange heat with the sucked outdoor air.

32 Claims, 15 Drawing Sheets

MONOLITHIC AIR CONDITIONER

BACKGROUND OF THE INVENTION

1. Field of the Invention

The present invention relates to an air conditioner, and more particularly, to a monolithic air conditioner that is designed to have a sufficient airflow space by reducing parts and to have an improved air discharge structure to prevent discharging air from leaking through other places other than an indoor air outlet.

2. Description of the Related Art

Generally, an air conditioner is operated as a refrigerant goes through a cooling cycle having a series of processes such as a compression process, a condensing process, an expanding process, and a vaporizing process. That is, after the refrigerant is compressed to a high temperature and pressure state, heat is discharged to an outer side by a condenser. Then, the temperature and pressure of the refrigerant are lowered as it goes through an expansion valve. Then, the refrigerant goes through the vaporizer to absorb heat and returns to the condenser.

Here, the compression, condensing and expansion processes are performed in an indoor unit of the air conditioner. The vaporizing process is performed by a blower fan and a heat exchanger.

Meanwhile, the air conditioner is generally classified into a monolithic air conditioner having indoor and outdoor units that are integrated and a split air conditioner having indoor and outdoor units that are split from each other. Particularly, the monolithic air conditioner is generated buried into an indoor wall such that a vaporizer is disposed facing an indoor side and a condenser is disposed facing an outdoor side.

FIG. 1 is an exploded perspective view of a monolithic air conditioner according to the related art.

Referring to FIG. 1, a typical monolithic air conditioner 10 includes a cabinet 21 defining an outer appearance of the air conditioner 10, a front panel 12 to be mounted on a front portion of the cabinet 21, a front grill 11 to be mounted on a front of the front panel 12 to guide suction of indoor air, and an indoor heat exchanger 13 mounted on a rear portion of the front panel 12 to exchange heat with the sucked indoor air.

The monolithic air conditioner 10 further includes an orifice unit 14, an air guide 15 defining indoor air outlet in an upper portion, and a scroll 16. When assembled, the indoor heat exchanger 13 is seated on a front of the orifice unit 14, the orifice unit 14 is seated on a front of the air guide 15, and the scroll 16 is mounted on a back of the air guide 15 to guide discharging of sucked indoor air.

The monolithic air conditioner 10 further includes a barrier 17, a shroud 18, an outdoor heat exchanger 20, and a base 23. When assembled, the barrier 17 is mounted on a back of the scroll 16 to divide inner space of the monolithic air conditioner 10 into an indoor air compartment and an outdoor air compartment. The shroud 18 is mounted on a back of the barrier 17 to guide sucked outdoor air. The outdoor heat exchanger 20 is mounted on a back of the shroud 18 to exchange heat with the sucked outdoor air. The base 23 receives parts from the front panel 12 through the outdoor heat exchanger 20.

The monolithic air conditioner 10 further includes an indoor fan 25, an outdoor fan 27, a driving motor 24 rotating the indoor fan 25 and the outdoor fan 27, a motor support 26, and control unit 22. When assembled, the indoor fan 25 is installed between the orifice unit 14 and the air guide 15 to suck indoor air, the outdoor fan 27 is installed between the barrier 17 and the shroud 18 to suck outdoor air, the motor support 26 supports the driving motor 24, and the control unit 22 is mounted on a back of the front panel 12 to control the operation of the monolithic air conditioner 10.

The monolithic air conditioner 10 further includes a shroud cover 18*a* and a brace 19. When assembled, the shroud cover 18*a* is detachably coupled to a top of the shroud 18, and the brace 19 connects the shroud 18 and the scroll 16.

Plenty of parts should be assembled to the monolithic air conditioner 10.

In detail, the monolithic air conditioner 10 includes the barrier 17 to divide its inner space to the indoor air compartment and the outdoor air compartment. Also, the monolithic air conditioner 10 includes the orifice unit 14, the air guide 15, and the scroll 16 to smoothly discharge the indoor air sucked. Further, the monolithic air conditioner 10 includes the brace 19 to connect the scroll 16 and the shroud 18 and the shroud cover 18*a* coupled to the top of the shroud 18 to guide discharging of sucked outdoor air.

As described above, since the monolithic air conditioner 10 requires excessive parts, the inner space of the monolithic air conditioner 10 reduces and thus the indoor air and the outdoor air cannot be smoothly circulated through the monolithic air conditioner 10. Also, the size of the monolithic air conditioner 10 increases. Further, assembling process of monolithic air conditioner 10 becomes complicated and the cost of the monolithic air conditioner 10 increases.

In addition, air leakage occurs when the sucked indoor air is discharged from the monolithic air conditioner 10. In detail, cool air leaked during the discharging operation is directed again to the indoor heat exchanger 13, thereby reducing heat exchange efficiency of the indoor heat exchanger 13.

SUMMARY OF THE INVENTION

Accordingly, the present invention is directed to a monolithic air conditioner that substantially obviates one or more problems due to limitations and disadvantages of the related art.

An object of the present invention is to provide a monolithic air conditioner that can be manufactured with fewer components and less manufacturing cost and through a simplified assembly process.

Another object of the present invention is to provide a monolithic air conditioner that can reduce pneumatic resistance of indoor air and outdoor air by increasing it inner space.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a monolithic air conditioner including: a cabinet; a front panel mounted on a front of the cabinet and including an indoor air intake, an indoor air outlet, and a discharge guide extended from a periphery of the indoor air outlet in a backward direction; an indoor heat exchanger mounted on a back of the front panel;

an air guide including a front portion on which the indoor heat exchanger is mounted and an orifice defined in a center portion to pass sucked indoor air therethrough; a scroll mounted on a back of the air guide to guide the sucked indoor air; an indoor fan mounted between the scroll and the air guide to suck the indoor air; a shroud mounted on a back of the scroll to guide sucked outdoor air and defining an orifice in a center portion to discharge the sucked outdoor air; an outdoor fan mounted on a back of the shroud to suck the outdoor air; a fan motor mounted on the scroll to drive the indoor fan and the outdoor fan; and an outdoor heat exchanger mounted on a back of the outdoor fan to exchange heat with the sucked outdoor air.

In another aspect of the present invention, there is provided a monolithic air conditioner including: a cabinet; a front panel mounted on a front of the cabinet, the front panel including an indoor air intake to suck indoor air, an indoor air outlet to discharge the sucked indoor air, and a discharge guide extended from the indoor air outlet in a backward direction; an heat exchanger assembly installed in the cabinet to allow refrigerant to exchange heat with sucked indoor and outdoor air; an air guide mounted on a back of the front panel, the air guide including an orifice defined in a center portion to pass the sucked indoor air therethrough and a discharge guide extended from a top to guide discharging of the sucked air; a scroll mounted on a back of the air guide to guide the sucked indoor air and including a discharge guide forwardly extended from a top to guide discharging of the sucked air; a shroud mounted on a back of the scroll to guide sucked outdoor air and defining an orifice in a center portion to discharge the sucked outdoor air; and a fan assembly installed in the cabinet to suck the indoor air and the outdoor air.

In a further another aspect of the present invention, there is provided a monolithic air conditioner including: a cabinet; a front panel mounted on a front of the cabinet and including a discharge guide extended in a backward direction; an air guide mounted on a back of the front panel and including a discharge guide connected to an end of the discharge guide of the front panel; a scroll mounted on a back of the air guide, the scroll including a guide surface at a side with a predetermine curvature to guide indoor air and a discharge guide extended from a top with a predetermined length to define an indoor air discharging passage; and a shroud mounted on a back of the scroll.

According to the present invention, the monolithic air conditioner is manufactured with fewer components, so that the monolithic air conditioner can be manufactured through a simplified assembly process with less cost.

Also, the inner space of the monolithic air conditioner increases and thus sucked indoor and outdoor air can flow smoothly in the monolithic air conditioner. Therefore, pneumatic resistance can be reduced.

Further, the monolithic air conditioner has an improved air discharging structure, so that discharging indoor air can be prevented from leakage and reversely flowing to the indoor heat exchanger.

In addition, the air guide is securely fixed to the scroll, so that the air guide can be prevented from shaking due to vibration generated during the operation of the monolithic air conditioner.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
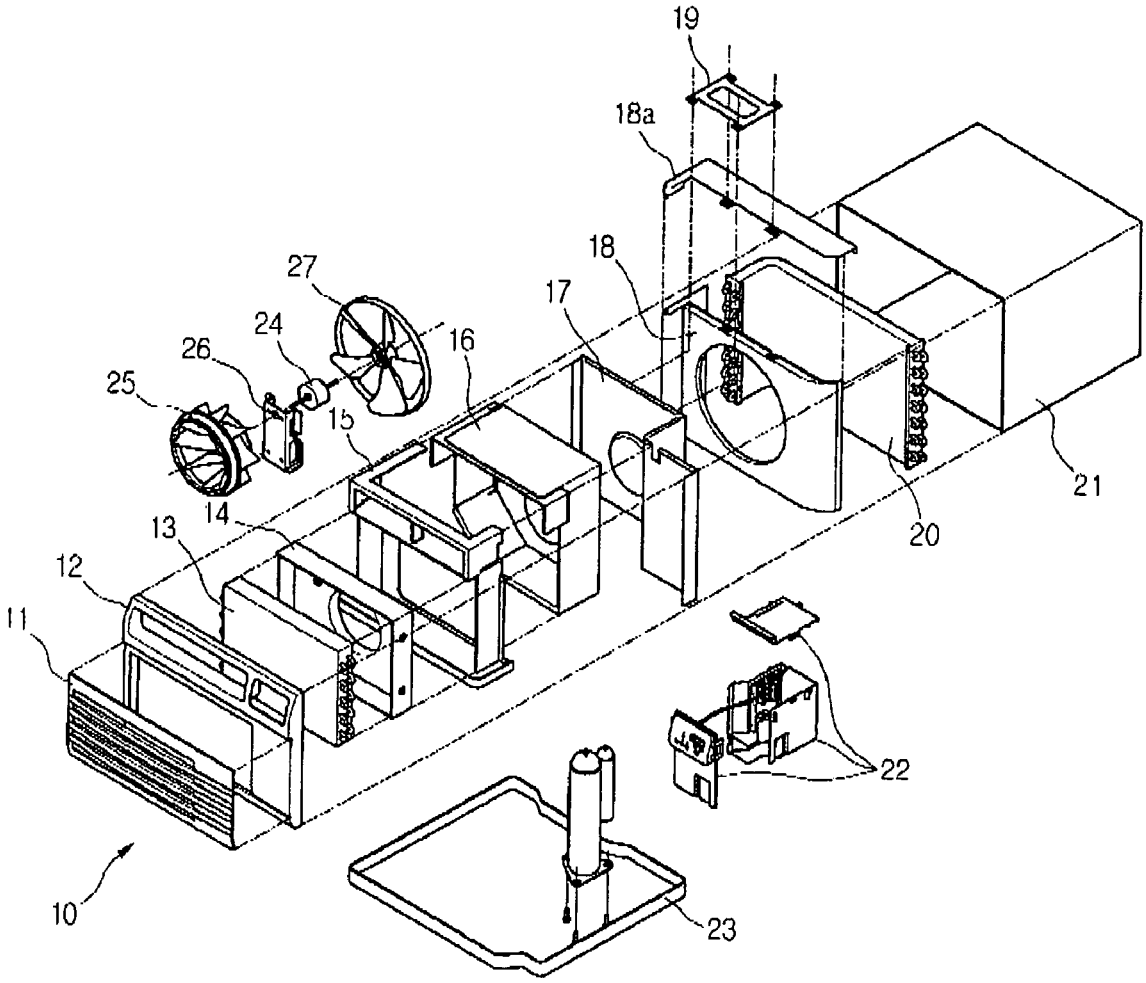
FIG. 1 is an exploded perspective view of a monolithic air conditioner according to the related art.
Figure 2:
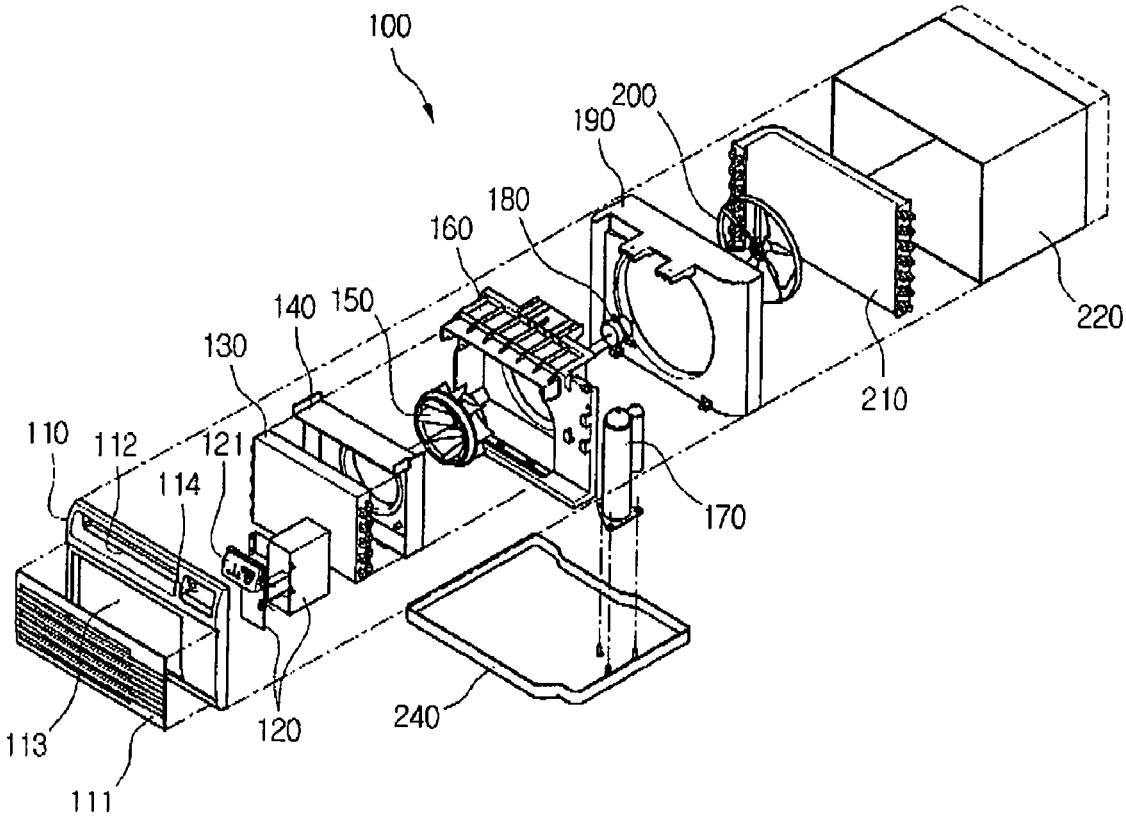
FIG. 2 is an exploded perspective view of a monolithic air conditioner according to the present invention.
Figure 3:
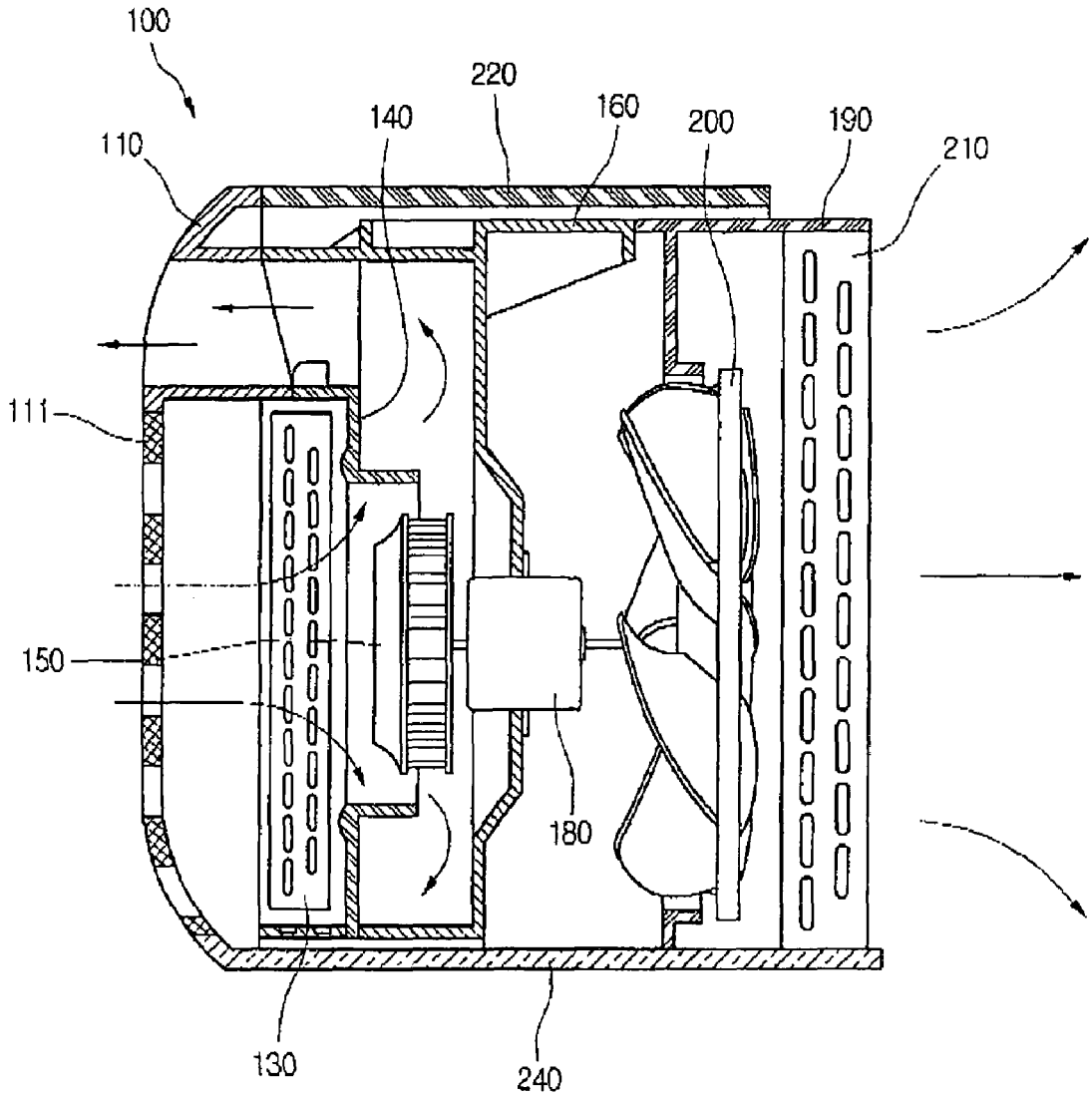
FIG. 3 is a side-sectional view of the monolithic air conditioner depicted in FIG. 2.

FIG. 2 is an exploded perspective view of a monolithic air conditioner according to the present invention, and FIG. 3 is a side-sectional view of the monolithic air conditioner depicted in FIG. 2.

Referring to FIGS. 2 and 3, a monolithic air conditioner 100 includes a cabinet 220 defining an outer appearance, a front panel 110 mounted on a front portion of the cabinet 220, a front grill 111 mounted on a front surface of the front panel 110 to guide airflow, an indoor heat exchanger 130 disposed in rear of the front panel 110 to allow introduced air to be heat-exchanged with a refrigerant, and a control box 120 disposed in rear of the front panel 110.

The front panel 110 is provided with an indoor air intake 113 on which the front grill 111 is mounted to allow the air to be introduced into the air conditioner 100. The front panel 110 is further provided with an indoor air outlet 112 above the indoor air intake 113 to exhaust the air, which is introduced into the air conditioner and heat-exchanged with the refrigerant flowing along the indoor heat exchanger 130, out of the air conditioner. The front panel 110 is further provided with a display insertion hole 114. A variety of electronic components for controlling the operation of the air conditioner 100 are installed in the control box 120. A display unit 121 for displaying the operation state of the air conditioner 100 is mounted on a front surface of the control box 120 and inserted into the display insertion hole 114 of the front panel 110 so that a user can identify the operation state of the air conditioner 100.

The monolithic air conditioner 100 further includes an air guide 140 mounted in rear of the indoor heat exchanger 130, a scroll 160 located in rear of the air guide 140 to guide the exhaust of the introduced indoor air, a shroud 190 mounted in rear of the scroll 160 to guide the outdoor air that is being introduced, a fan motor 180 inserted in a center of the scroll 160, an indoor fan 150 shaft-connected to a front portion of the fan motor 180, and an outdoor fan 200 shaft-connected to a rear portion of the fan motor 180.

Figure 8:
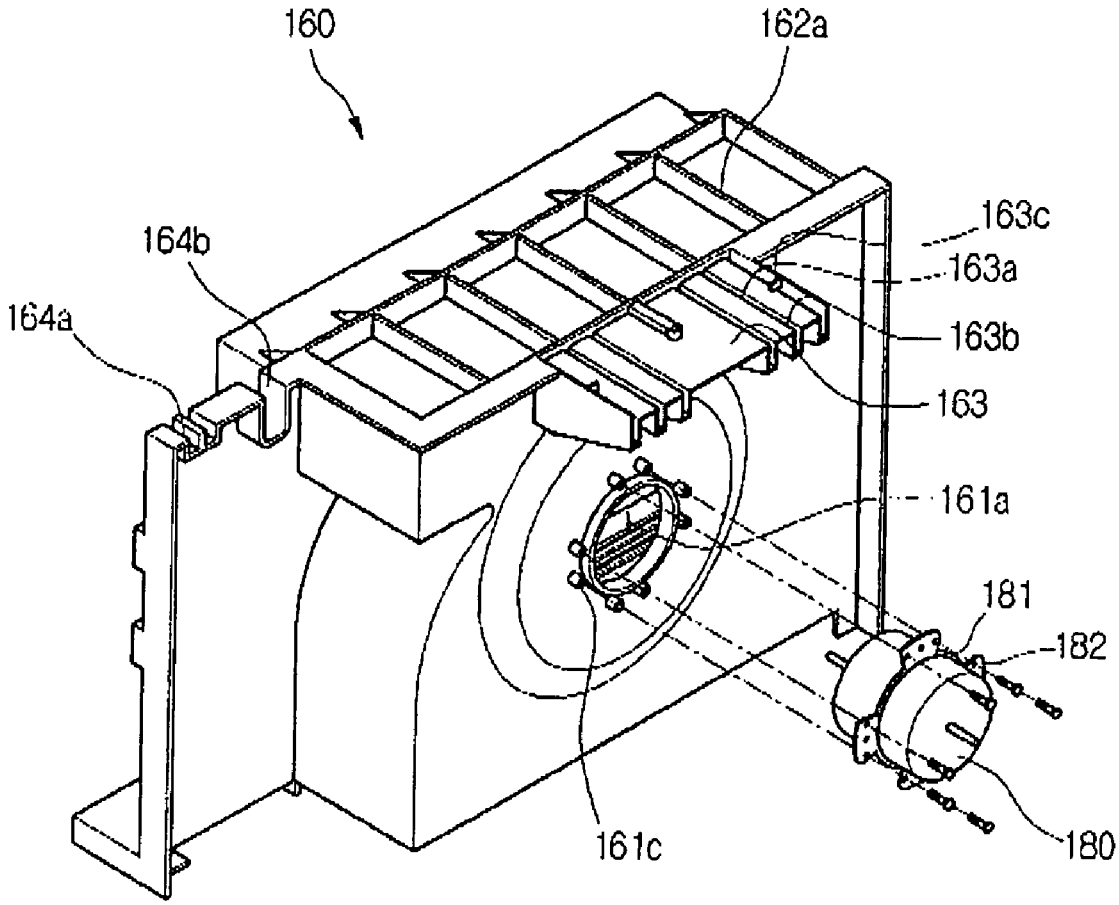
FIG. 8 is a rear perspective view of the scroll depicted in FIG. 7.

Describing in more detail, the air guide 140 is provided at a center with a hole to allow the indoor air introduced by the indoor fan 150 to be directed toward the scroll 160. The air guide 140 is connected to the indoor air intake 113 of the front panel 110 to guide the air. Referring to FIG. 8, the fan motor 180 is fixed to a back of the scroll 160 by a motor mount 181. The motor mount 181 includes a plurality of coupling tabs 182 along its periphery and holes defined in the coupling tabs 182. Fasteners such as screws are inserted into motor coupling bosses 161*c* through the holes defined in the coupling tabs 182 to fix the fan motor to the back of the scroll 160.

The monolithic air conditioner 100 further includes an outdoor heat exchanger 210 for exchanging heat with sucked outdoor air, a base 240 on which components from the front panel 110 to the outdoor heat exchanger 210 are seated, and a compressor 170 fixed on the base 240 for compressing refrigerant.

The operation of the above-described monolithic air conditioner 100 will be described hereinafter.

When the air conditioner 100 is operated, the refrigerant stored in the compressor 170 is compressed to a high temperature and pressure. In addition, the fan motor 180 is operated to rotate the indoor and outdoor fans 150 and 200. The compressed refrigerant is directed to the outdoor heat exchanger 210. Then, when the outdoor fan 190 rotates, the outdoor air is introduced through the outdoor air intake. The introduced air is directed to the outdoor fan 200 through a hole formed on the shroud 190. The air is further directed to the outdoor heat exchanger 210 through the outdoor fan 200 and the air is heat-exchanged with the refrigerant flowing along the outdoor heat exchanger 210 to be increased in a temperature. The heated air is exhausted to the outdoor side.

Meanwhile, the refrigerant flowing along the outdoor air exchanger 210 is lowered in the temperature by being heat-exchanged with the introduced outdoor air. Then, the refrigerant passes through an expansion valve (not shown) provided in the air conditioner 100 to be quickly lowered in the temperature and pressure. The refrigerant passed through the expansion valve is directed to the indoor heat exchanger 130. In addition, the indoor air is introduced into the air conditioner 100 through the front grill 111 by the rotation of the indoor fan 150. The introduced indoor air is lowered in the temperature while passing through the indoor heat exchanger 130. At this point, the refrigerant flowing along the indoor heat exchanger 130 is increased in the temperature by the heat exchanged with the introduced indoor air. Then, the air is directed to the scroll 160 via the air guide 140. The air directed to the scroll 160 is directed to the indoor air outlet 112 of the front panel 110 along an air passage defined by the air guide 140 and the scroll 160. Then, the air is exhausted through the indoor air outlet 112. The refrigerant passed through the indoor heat exchanger 130 is returned to the compressor 170.

Figure 4:
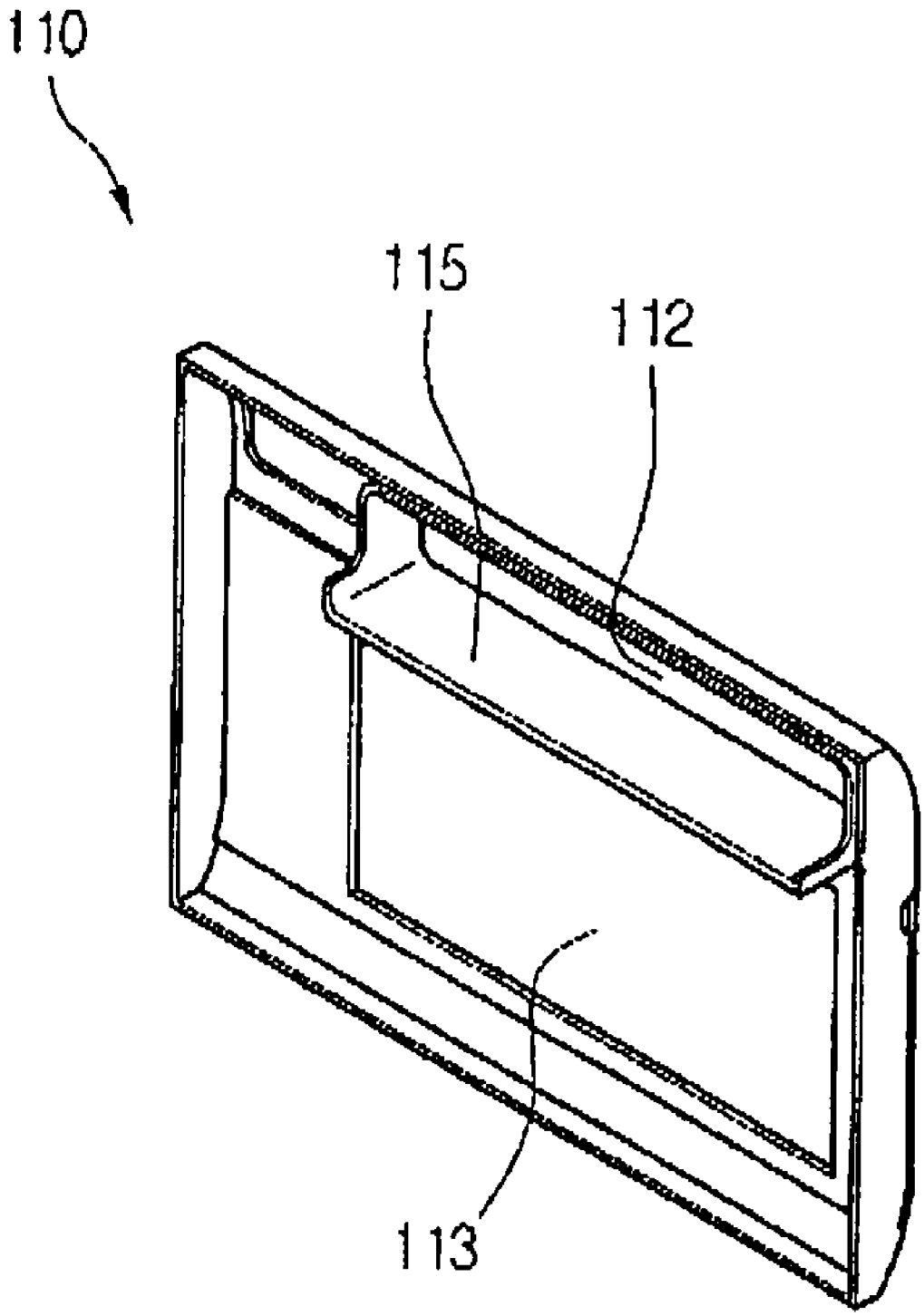
FIG. 4 is a rear perspective view of a front panel according to the present invention.

FIG. 4 is a rear perspective view of a front panel according to the present invention.

Referring to FIG. 4, as described above, the front panel 110 includes the indoor air intake 113 and the indoor air outlet 112 above the indoor air intake 113. The front panel 110 further includes a discharge guide 115 extended from a lower periphery of the indoor air outlet 112 in a backward direction.

In detail, the discharge guide 115 extended from a back of the front panel 110 is seated on a discharge guide (described later) formed on an upper portion of the air guide 140. Therefore, air can be discharged to the indoor with minimum flow loss after the air is cooled by the indoor heat exchanger 130.

Figure 5:
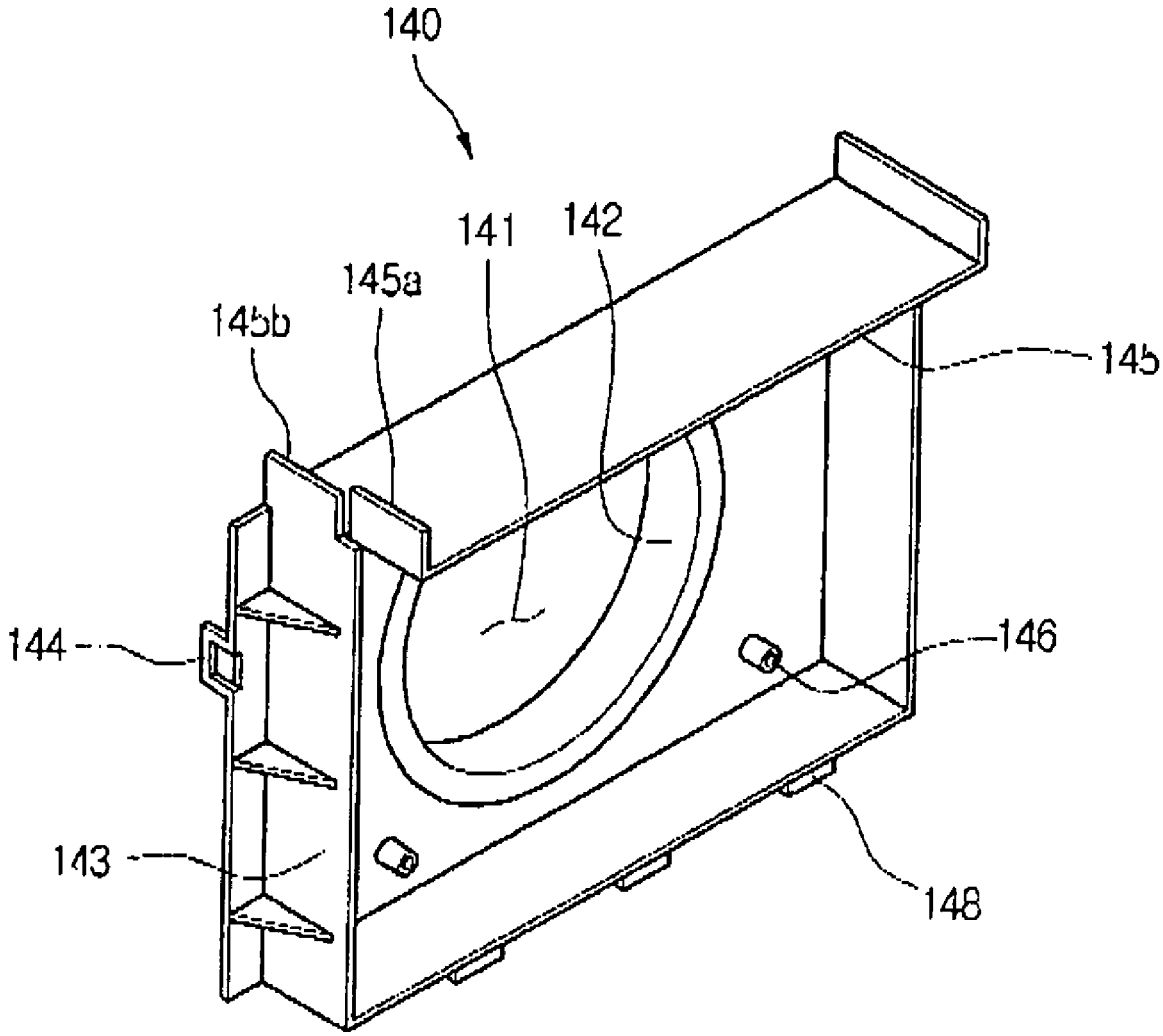
FIG. 5 is a front perspective view of an air guide according to the present invention.
Figure 6:
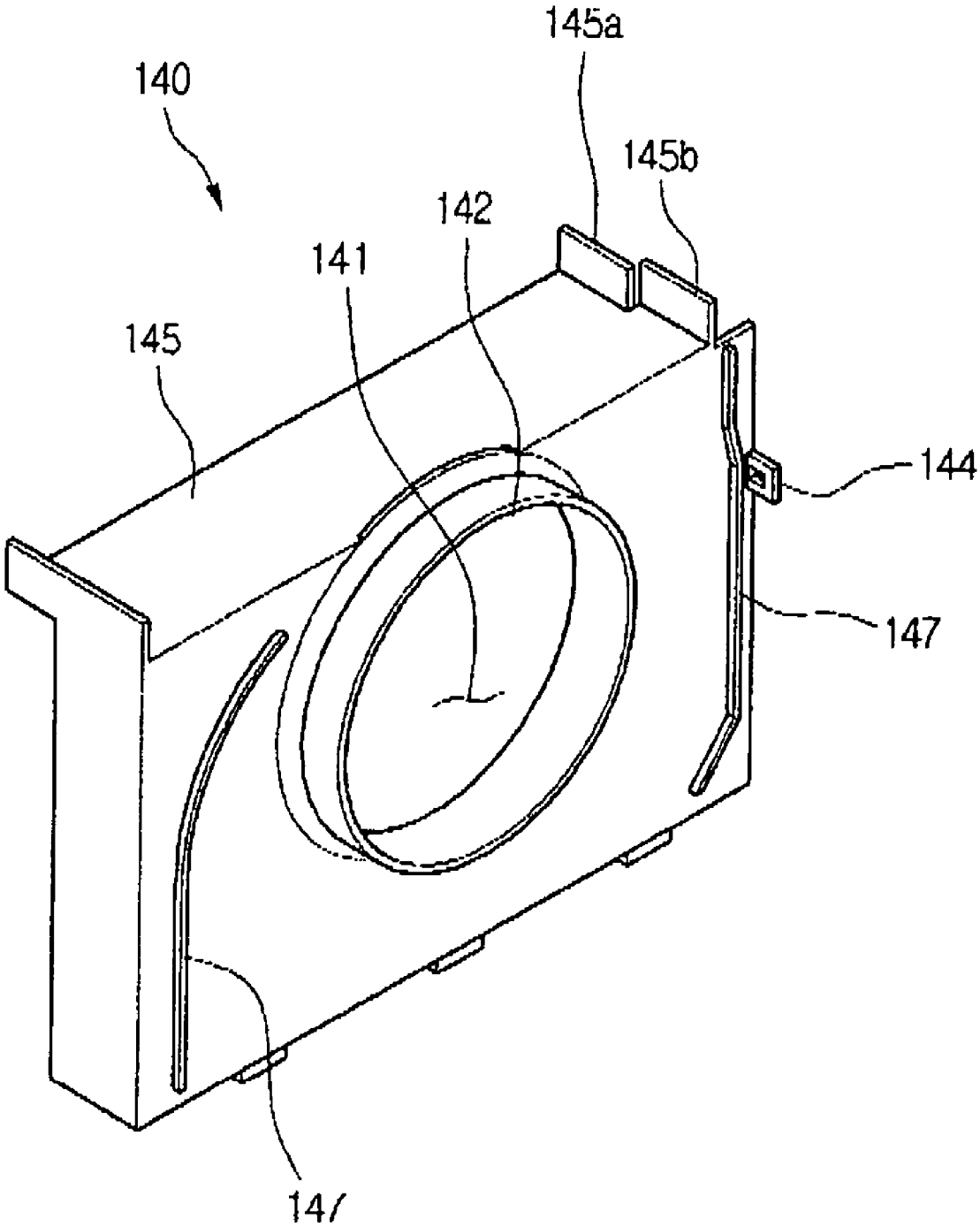
FIG. 6 is a rear perspective view of the air guide depicted in FIG. 5.

FIG. 5 is a front perspective view of an air guide according to the present invention, and FIG. 6 is a rear perspective view of the air guide depicted in FIG. 5.

Referring to FIGS. 5 and 6, the air guide 140 receives the indoor heat exchanger 130 from the front.

In detail, the air guide 140 includes an orifice 141 in a center portion, and an orifice rim 142 around the orifice 141, a supporting extension 143 extended from a lateral and bottom periphery with a predetermined height to support the indoor heat exchanger 130, a discharge guide 145 extended from a top periphery in a front direction, a coupling end 144 extended from a lateral side in a back direction, and leakage preventing ribs 147 form on back surfaces with predetermined lengths to prevent leakage during air discharging.

In more detail, the orifice rim 142 is extended a predetermined length in a back direction to minimize pneumatic resistance when air is sucked. Also, a plurality of coupling protrusions 148 are formed on a bottom of the supporting extension 143 for coupling of the air guide 140 to the scroll 160. Owing to the coupling protrusions 148, the air guide 140 can be prevented from shaking during operation. The coupling end 144 is formed for coupling with a coupling hook (described later) formed on a lateral side of the scroll 160 to further prevent the air guide 140 form shaking.

The air guide 140 further includes a plurality of heater fixing bosses 146 for coupling with a heater. By installing the heater between the air guide 140 and the indoor heat exchanger 130, indoor air sucked can be heated in a heating mode. In detail, the sucked indoor air is first heated while passing through the indoor heat exchanger 130 and secondly heated while passing through the heater. Therefore, the air can be heated to a set temperature more rapidly.

The leakage preventing ribs 147 formed on the back of the air guide 140 have a corresponding shape to a front periphery of the scroll 160 so as to prevent leakage of discharging air. Upper portions of the leakage preventing ribs 147 are curved such that the leakage preventing ribs 147 approach each other when going to the discharge guide 145. In detail, since the indoor fan 150 is a centrifugal fan that draws air in an axial direction and discharges the air in a radial direction, drawn air as is directed upward as it is rotated.

Further, both sides of the discharge guide 145 are bent upward with a predetermined curvature to minimize pneumatic resistance when the indoor air is discharged. In detail, the bent right side of the discharge guide 145 is divided into an inner guide 145*a* and an outer guide 145*b* behind the inner guide 145*a*. The inner guide 145*a* and the outer guide 145*b* are spaced a predetermined distance apart from each other in a lateral direction to receive a discharge guide (refer to 162 in FIG. 7) of the scroll 160.

Figure 7:
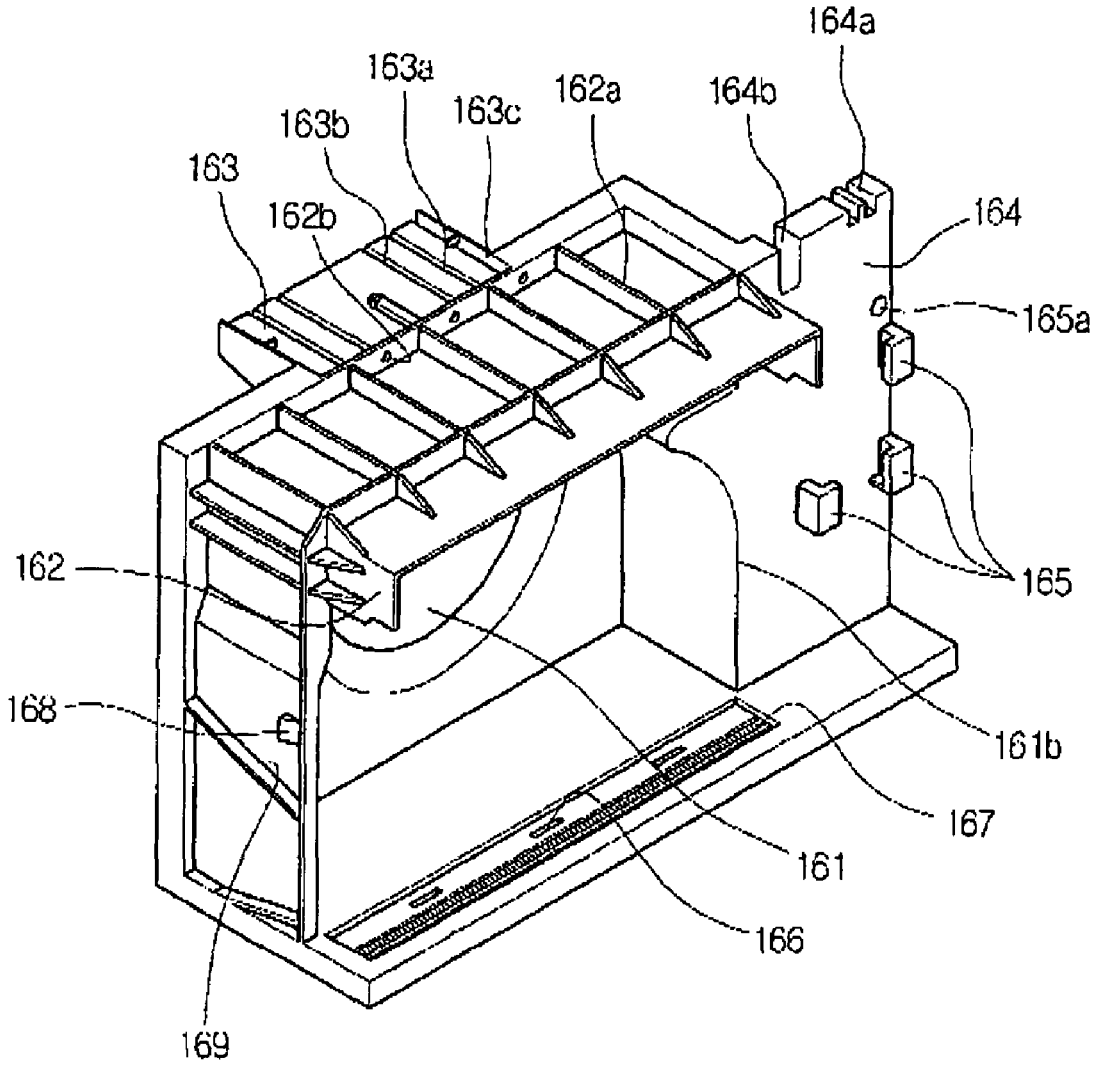
FIG. 7 is a front perspective view of a scroll according to the present invention.
Figure 9:
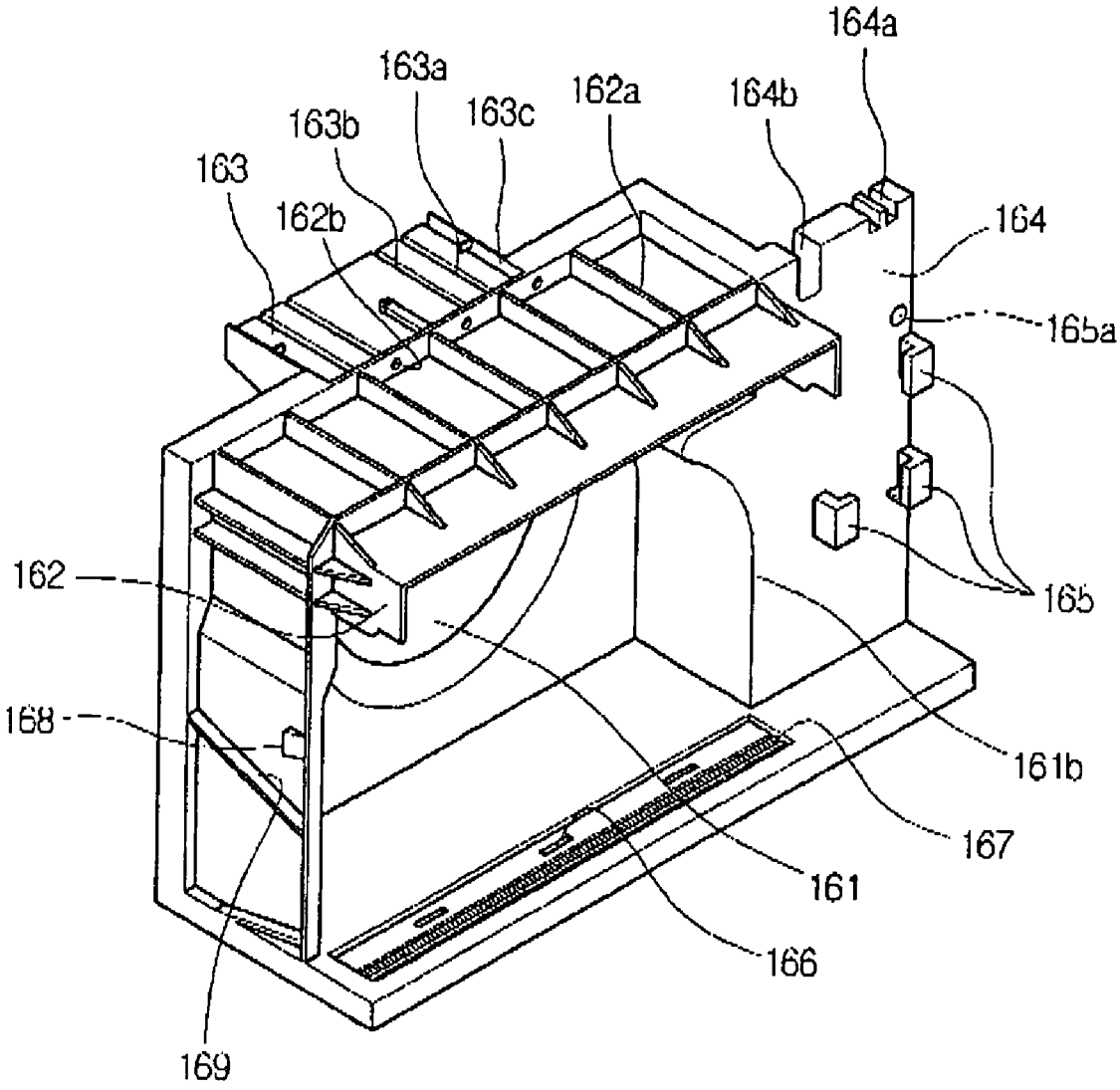
FIG. 9 is a side perspective view of the scroll depicted in FIG. 7.

FIG. 7 is a front perspective view of a scroll according to the present invention, FIG. 8 is a rear perspective view of the scroll depicted in FIG. 7, and FIG. 9 is a side perspective view of the scroll depicted in FIG. 7.

Referring to FIGS. 7 to 9, the scroll 160 has a rectangular shape and defines a cavity to receive the air guide 140 and the indoor fan 150.

In detail, the scroll 160 includes an fan receiving portion 161 recessed at a predetermined depth to receive the indoor fan 150, an motor insertion hole 161*a* defined in a center of the fan receiving portion 161 to receive the fan motor 150, a control box mounting portion 164 at one side for mounting the control box 120, and a discharge guide 162 extended from an upper periphery with a predetermined length to guide discharging air.

In more detail, the discharge guide 162 is extended from the upper periphery of the scroll 160 in a front direction with a predetermined length. Both sides of the discharge guide 162 are bent downward to prevent the discharging air from leaking. Also, the discharge guide 145 of the air guide 140 and the discharge guide 115 of the front panel 110 are coupled to a bottom of the discharge guide 162.

Further, the scroll 160 includes a lower extension extended from a front lower periphery in a front direction to receive the indoor heat exchanger 130 and the air guide 140. That is, the air guide 140 is mounted on a front of the scroll 160, and then the indoor heat exchanger 130 is mounted on a front of the air guide 140.

In detail, the lower extension of the scroll 160 defines at least one drain groove 167 in a portion where the indoor heat exchanger is to be seated and coupling holes 166 in a portion where the air guide 140 is seated. Into the coupling holes 166, the coupling protrusions 148 formed on the bottom of the air guide 140 is to be inserted. Water condensing on the surface of the indoor heat exchanger 130 is drained along the drain groove 167. The lower extension of the scroll 160 further defines a hole in an end of the drain groove 167 to drop the water to the base 240.

Meanwhile, the scroll 160 further includes an air guide surface 161*b* beside the control box mounting portion 164. The air guide surface 161*b* has a gradually increasing curvature in an upward direction. The air guide surface 161*b* and a front edge of the scroll 160 opposing to the air guide surface 161*b* make contact with the leakage preventing ribs 147 formed on the back of the air guide 140. Therefore, air discharged from the indoor fan 150 can move toward the discharge guide 162 while it whirls in the scroll 160. The leakage preventing ribs 147 prevents the discharging air from leaking outside.

The control box mounting portion 164 is outwardly extended from a side of the scroll 160 to receive the control box 120. At a back of the control box mounting portion 164, the compressor 170 is disposed. The control box mounting portion 164 defines a tube insertion slot 164*b* in an upper end to pass a refrigerant tube and the expansion valve therethrough. The control box mounting portion 164 further defines wire insertion slots 164*a* beside the tube insertion slot 164*b* to pass wires extended from the control box 120 therethrough. In addition, the control box receiving portion 164 includes a plurality of coupling ribs 165 on a front surface for mounting of the control box 120.

The coupling ribs 165 fix left and right sides of the control box 120. The coupling ribs are L-shaped such that the control box 120 can be mounted on by sliding it down. A fastener such as a screw is further used to firmly fix the control box 120 to the control box mounting portion 164. To receive the fastener, the control box mounting portion 164 defines a coupling hole 165*a*.

The scroll 160 further includes shroud coupling end 163 extended from a top in a backward direction and the plurality of motor coupling bosses 161*c* on a back surface of the fan receiving portion 161.

In detail, the shroud coupling end 163 is extended form an upper back of the scroll 160 with a predetermined length. The shroud coupling end 163 may be formed at a center of the upper back of the scroll 160. The shroud coupling end 163 defines a plurality of guide slots 163*b* in a front and back direction with a predetermined width and depth. Preferably, the shroud coupling end 163 defines three guide slots 163*b* in each side. The shroud coupling end 163 further defines coupling holes 163*a* in a top surface to receive a fastener for fixing the shroud 190 to the scroll 160.

The shroud coupling end 163 further includes restricting ribs 163*c* with a predetermined length in a side-to-center direction.

In detail, the restricting ribs 163*c* make contact with scroll coupling ends (refer to 196 in FIG. 13) of the shroud 190. The restricting ribs 163*c* restricts overlap area between the scroll coupling ends 196 and the shroud coupling end 163. The guide slots 163*b* receive slide ribs (refer to 196*a* in FIG. 13) formed on the scroll coupling ends 196. The coupling of the scroll coupling ends 196 and the shroud coupling end 163 will be further described later.

The motor coupling bosses 161*c* are on the back surface of the scroll 160 around the motor insertion hole 161*a* to receive the fan motor 180. After the fan motor 180 is inserted through the motor insertion hole 161*a*, the coupling tabs 182 extended from the outer surface of the fan motor 180 are seated on the motor coupling bosses 161*c*. Then, fasteners such as screws are inserted into the motor coupling bosses 161*c* through the coupling tabs 182.

Meanwhile, the scroll 160 further includes a plurality of reinforcement ribs 162*a* formed on a side surface and a top surface and drain holes 162*b* in the reinforcement ribs 162*a* to drain condensed water. Since cool air is circulated in the scroll 160, water is condensed on the surface of the scroll 160. Therefore, the drain holes 162*b* are defined in the reinforcement ribs 162*a* to drain the condensed water.

The scroll 160 further includes a drain guide rib 169 to guide the dropping water from the drain holes 162*b* to the bottom of the scroll 160. In detail, the drain guide rib 169 is sloped from a back to a front to direct the condensed water to the bottom of the scroll 160.

The scroll 160 further includes a coupling hook 168 on a side surface for fitting into the coupling end 144 formed on a side of the air guide 140. Therefore, the air guide 140 can be securely fixed to the scroll 160 by the coupling of the coupling hook 168 and the coupling end 144 (refer to FIG. 11). At the same time, the coupling protrusions 148 formed on the bottom of the air guide 140 are inserted into the coupling holes 166 defined in the lower extension of the scroll 160.

Figure 10:
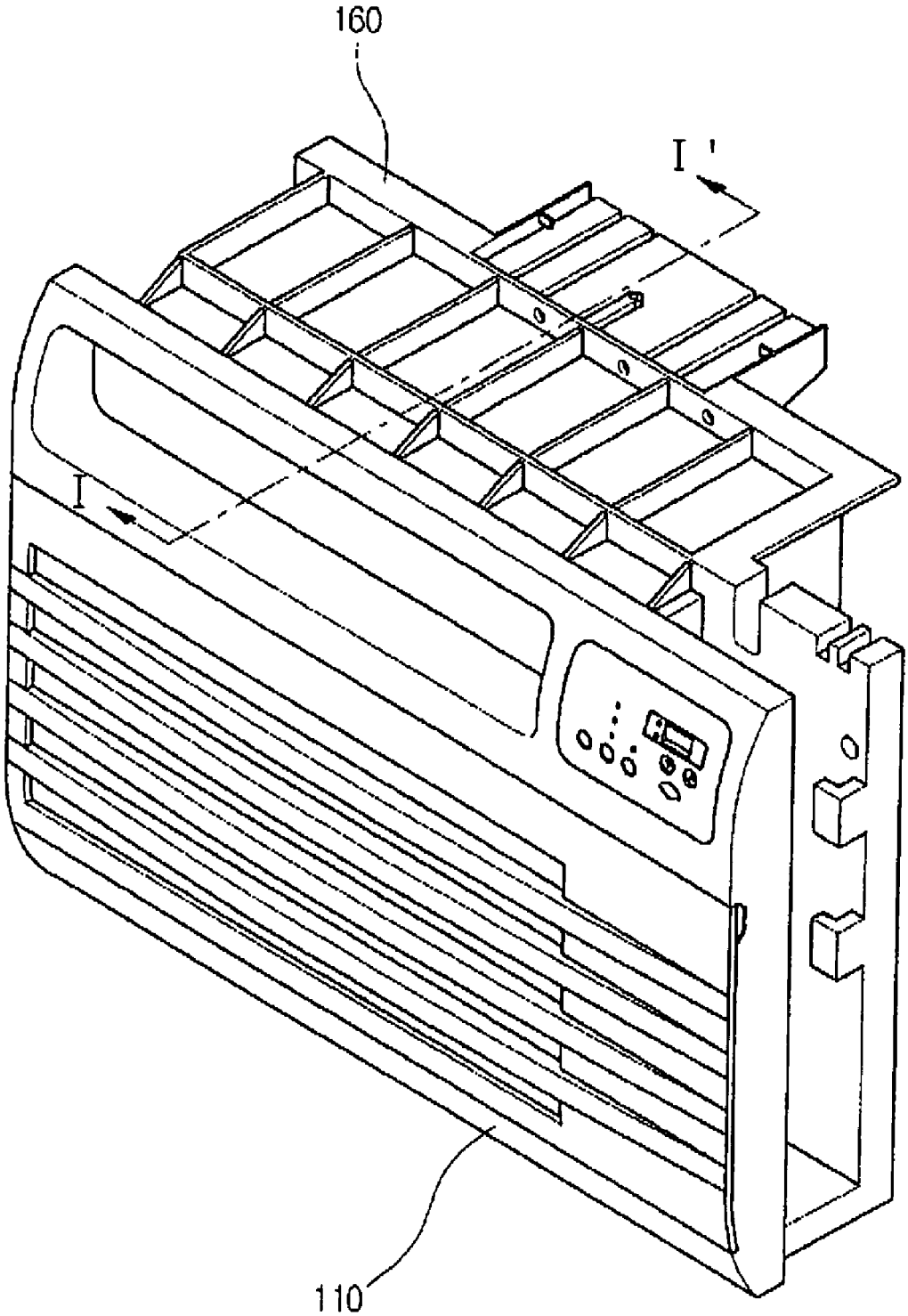
FIG. 10 is an assembled perspective view of a front panel, an air guide, and a scroll of a monolithic air conditioner according to the present invention.
Figure 11:
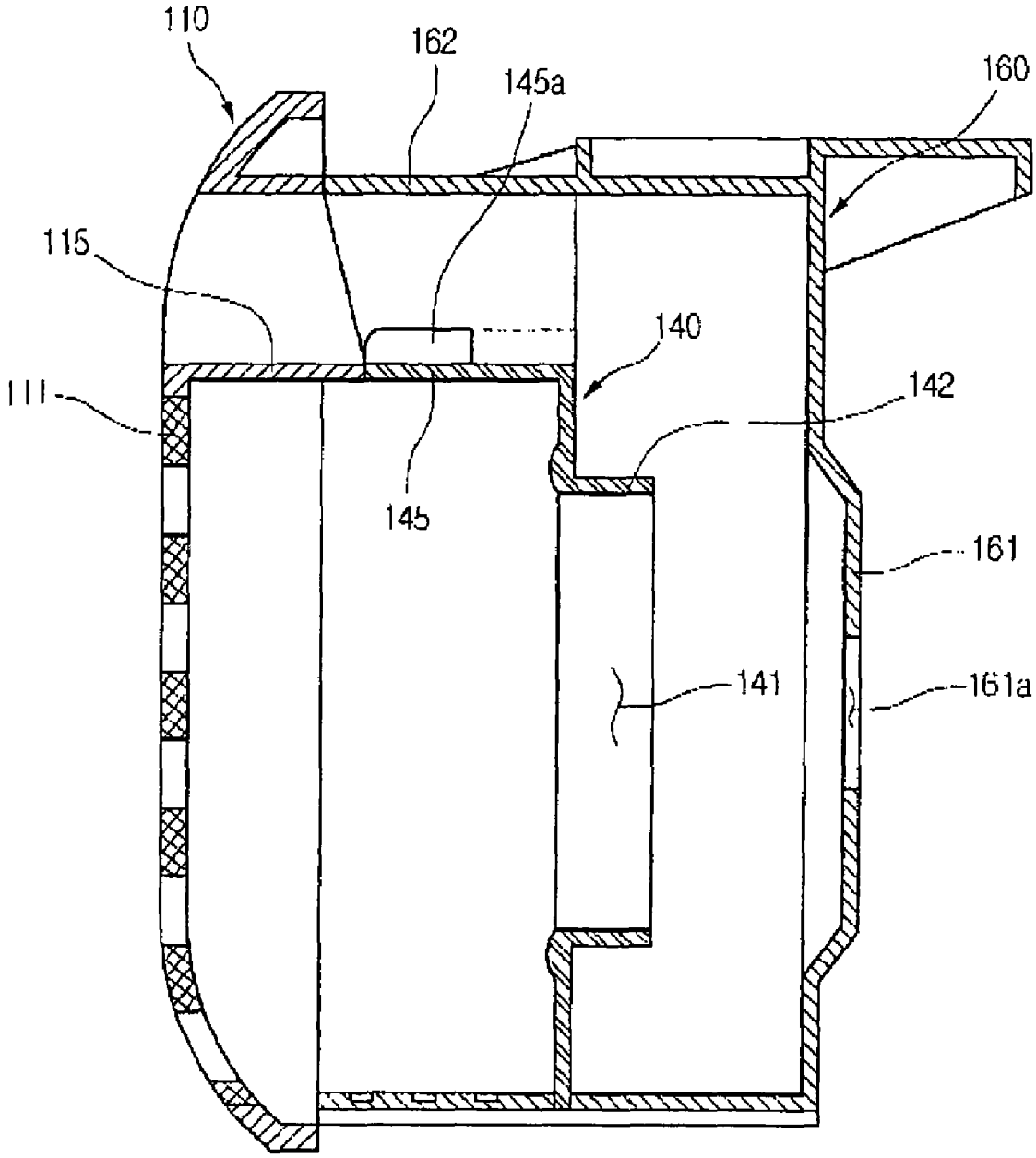
FIG. 11 is a sectional view taken along line I-I' in FIG. 10.

FIG. 10 is an assembled perspective view of a front panel, an air guide, and a scroll of a monolithic air conditioner according to the present invention, and FIG. 11 is a sectional view taken along line I-I' in FIG. 10.

As described above, the discharge guide 115 extended from a back of the front panel 110 is abutted against an end of the discharge guide 145 of the air guide 140. Also, the discharge guide 162 of the scroll 160 is abutted against side and top portions of the discharge guide 115 of the front panel 110.

In this structure, indoor air is drawn into the scroll 160 by the indoor fan 180 and circulated in the scroll 160. In detail, the drawn air is moved upward to the indoor air outlet as it is circulated along the air guide surface 161*b*.

Figure 12:
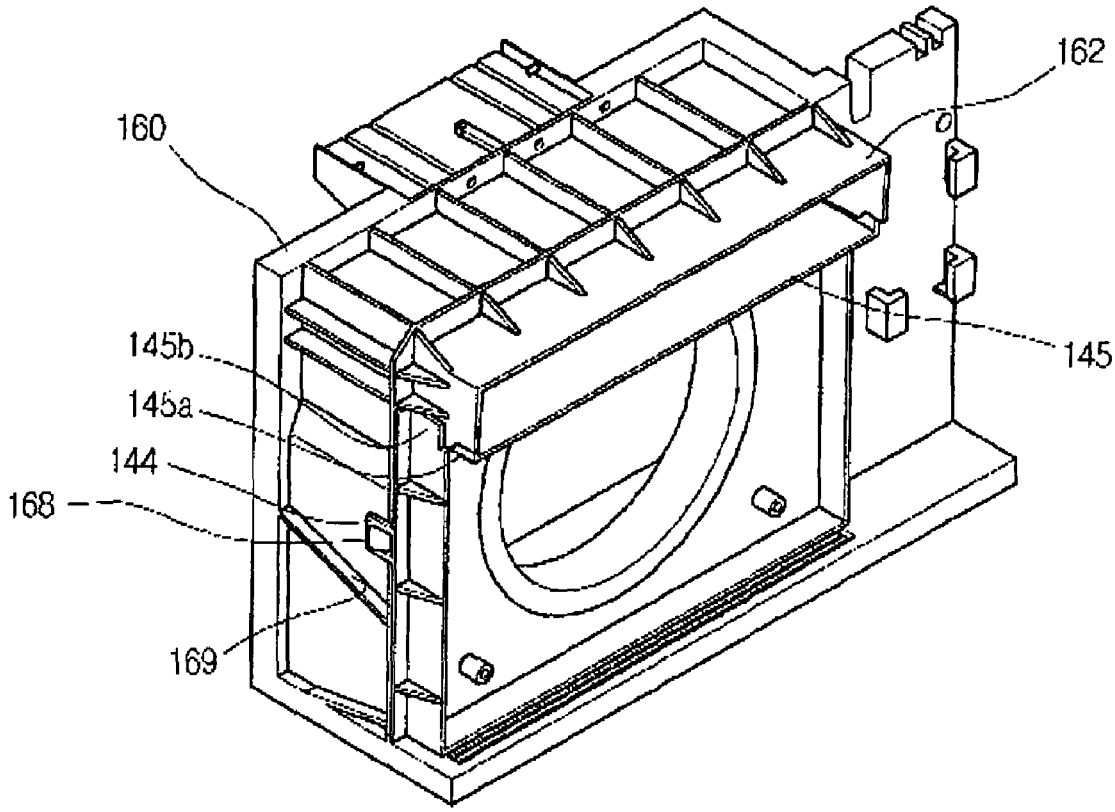
FIG. 12 is an assembled perspective view of an air guide and a scroll of a monolithic air conditioner according to the present invention.

FIG. 12 is an assembled perspective view of an air guide and a scroll of a monolithic air conditioner according to the present invention.

Referring to FIG. 12, owing to the coupling protrusions 148 and the coupling end 144 that are respectively formed on a bottom and a side of the air guide 140, the air guide 140 can be securely fixed to the scroll 160.

As described above, the coupling protrusion 148 are securely coupled to a bottom of the scroll 160 and the coupling end 144 securely coupled to a side of the scroll 160, so that the air guide 140 can be prevented from shaking during operation of the monolithic air conditioner 100.

Further, the coupling hook 168 of the scroll 160 is fitted into the coupling end 144 of the air guide 140, such that the leakage preventing ribs 147 can be tightly abutted against lateral sides of the scroll 160. Therefore, discharging air can be prevented from leaking.

Further, as described with reference to FIG. 5, the discharge guide 162 of the scroll 160 is inserted between the inner guide 145*a* and the outer guide 145*b*, such that the discharge guide 162 of the scroll 160 can be securely coupled to the discharge guide 145 of the air guide 140. Therefore, the air guide 140 can be securely fixed to the scroll 160 without shaking.

Figure 13:
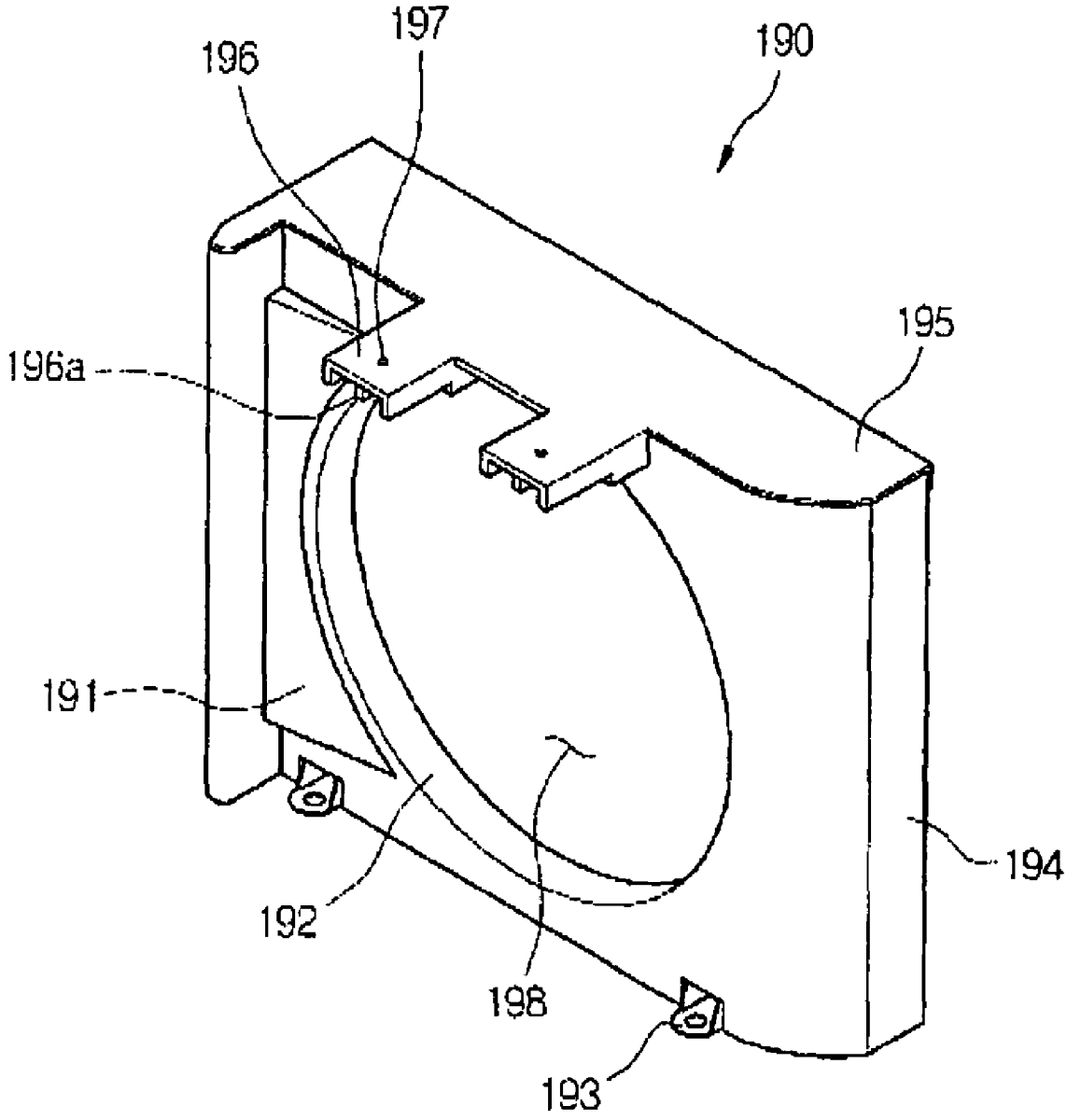
FIG. 13 is a front perspective view of a shroud according to the present invention.
Figure 14:
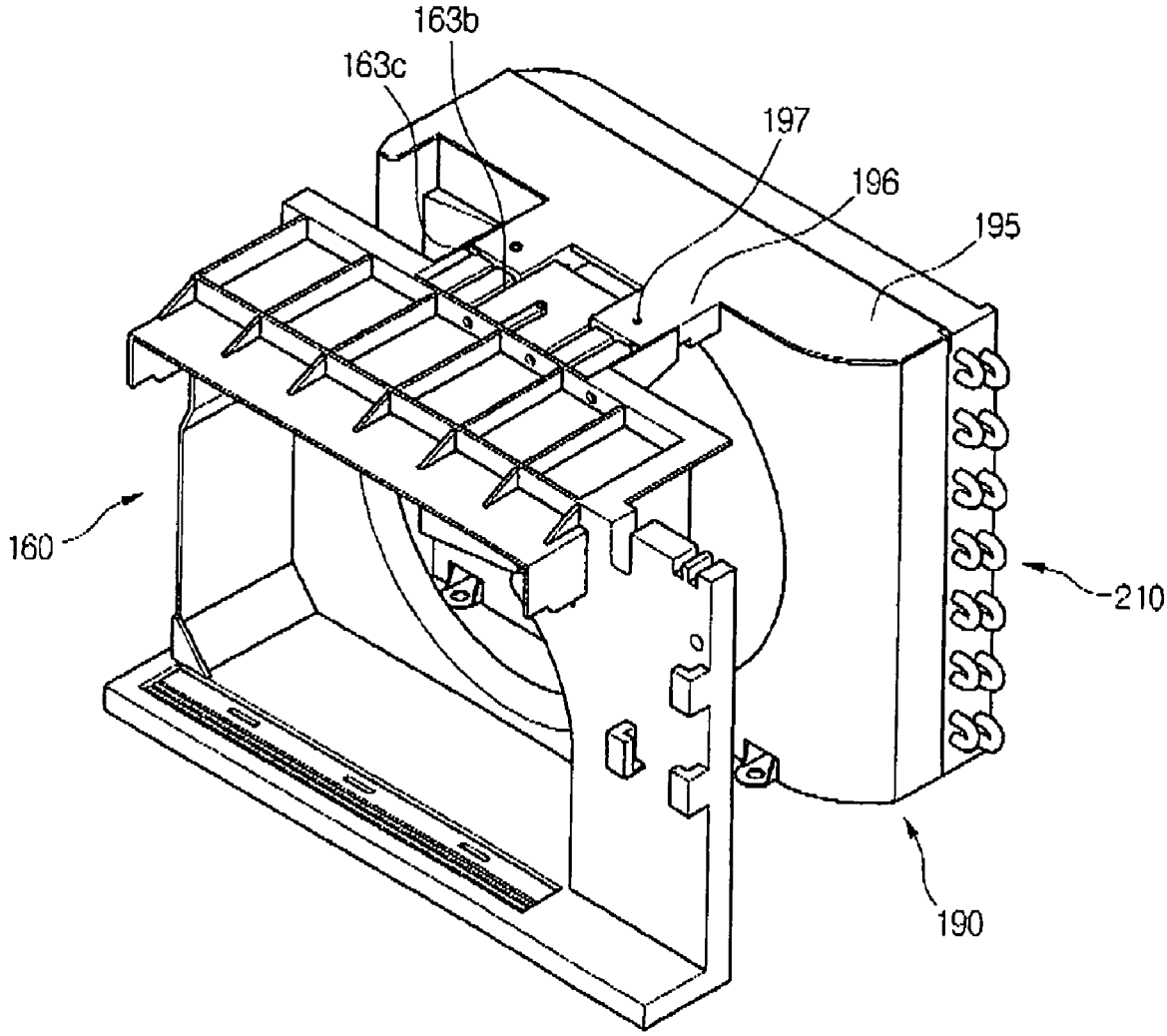
FIG. 14 is a perspective view illustrating a connection between the shroud depicted in FIG. 13 and a scroll.

FIG. 13 is a front perspective view of a shroud according to the present invention, and FIG. 14 is a perspective view illustrating a connection between the shroud depicted in FIG. 13 and a scroll.

Referring to FIGS. 13 and 14, the shroud 190 is disposed behind the scroll 160.

In detail, the shroud 190 is coupled to the scroll 160 with a predetermined distance therebetween. Outdoor air is sucked into the space between the shroud 190 and the scroll 160, and then it is directed to the outdoor heat exchanger 210 through the shroud 190.

The shroud 190 includes a body 191, an orifice 198 defined in a center portion of the body 191, an orifice rim 192 around the orifice 198, the scroll coupling ends 196 forwardly extended from an upper end of the body 191 with a predetermined length, an air suction guide 194 backwardly extended from a side of the body 191 with a predetermined curvature, base coupling portions 193 formed on a lower end of the body 191 for coupling with the base 240, and a cover portion 195 backwardly extended from an upper end of the body 191 to cover a top of the outdoor heat exchanger 210.

In detail, the cover portion 195, the scroll coupling ends 196, and the body 191 are injection molded in one piece. According to the related art, a separate connection member is used to connect a shroud and a scroll, and a separate cover is used to cover a top of an outdoor heat exchanger. However, the present invention provides the shroud 190 integrally formed with the scroll coupling ends 196 and the cover portion 195, thereby reducing the number of components required and simplifying the assembling process.

Further, the slide ribs 196*a* formed on bottoms of the scroll coupling ends 196 are inserted into the guide slots 163*b* formed in the shroud coupling end 163 of the scroll 160. When leading ends of the scroll coupling ends 196 make contact with the restricting ribs 163*c* of the shroud coupling end 163, coupling holes 197 defined in the scroll coupling ends 196 are aligned with the guide holes 163*a* defined in the shroud coupling end 163. Then, fasteners such as screws are fitted through the aligned coupling holes 197 and the guide holes 163*a* to securely fix the shroud 190 to the scroll 160.

Meanwhile, the outdoor fan 200 is mounted on a front of the shroud 190 to suck outdoor air. The sucked air is guided along the air suction guide 194. Then, the air is guided by the orifice rim 192 toward the outdoor heat exchanger 210 through the orifice 198. The air takes heat from the outdoor heat exchanger 210 as it passes through the outdoor heat exchanger 210, and then the air is discharged to the outside at a high temperature.

Figure 15:
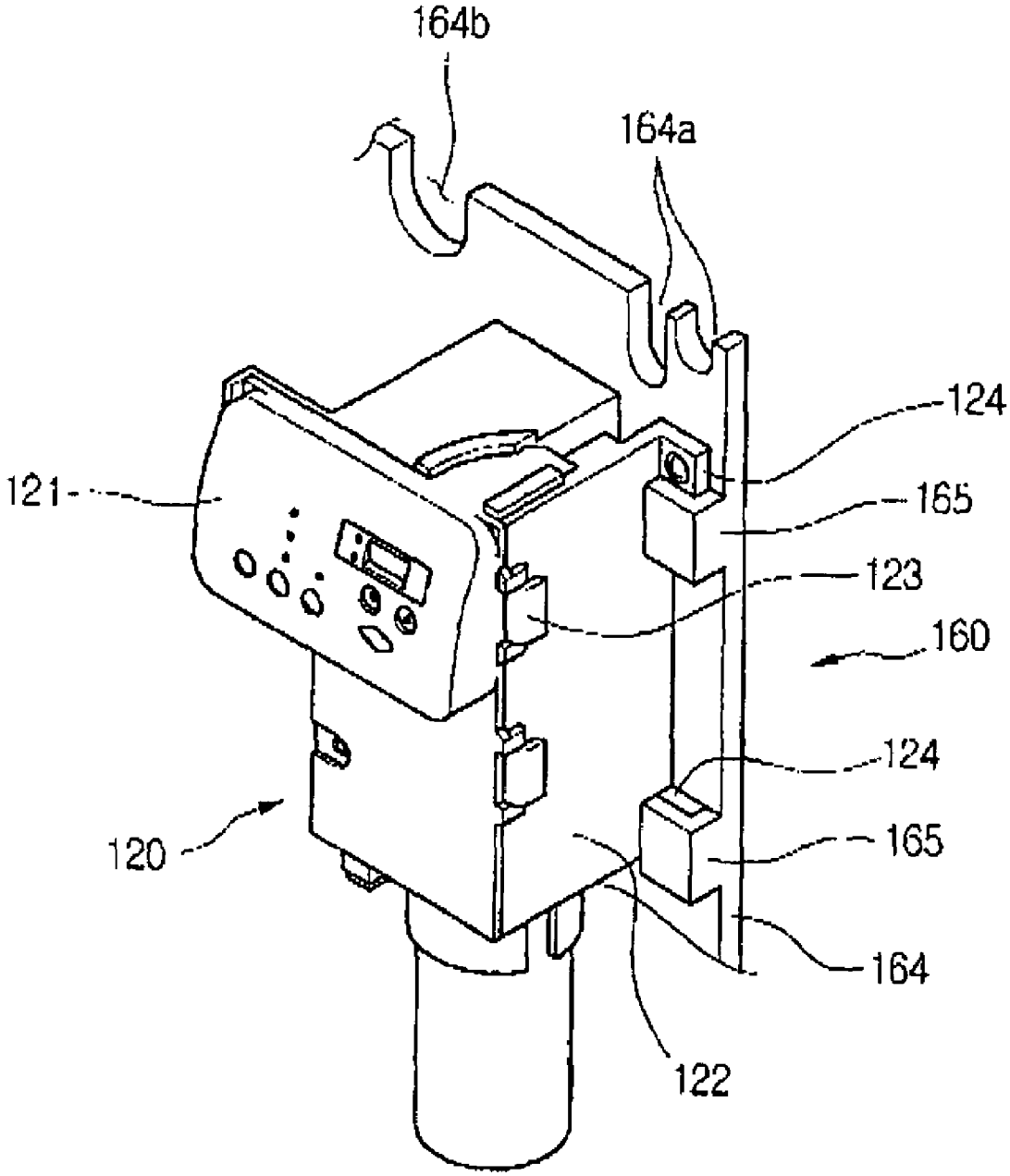
FIG. 15 is a perspective view of an installed control box according to the present invention.

FIG. 15 is a perspective view of an installed control box according to the present invention.

Referring to FIG. 15, the control box 120 is mounted on the control box mounting portion 164 of the scroll 160.

In detail, the control box 120 includes a housing 122 accommodating electric parts and a display 121 movably mounted on a front of the housing 122.

In more detail, the housing 122 includes a hinge 123 for the movably mounting of the display 121. The display 121 includes an LED or LCD window to display the operating state of the monolithic air conditioner 100. The housing 122 further includes extension ends 124 on a rear end. Preferably, the extension ends 124 are formed on both sides of the housing 122 and at upper and lower locations of the housing 122. At least one of the extension ends 124 defines a through hole for receiving a fastener such as a screw. Therefore, the control box 120 can be securely fixed to the control box mounting portion 164.

Further, the control box mounting portion 164 includes the coupling ribs 165 to receive the extension ends 124. As described with reference to FIG. 7, the extension ends 124 slide into the coupling ribs 165 for fixing the control box 120 to the control box mounting portion 164 of the scroll 160. The control mounting portion 164 further includes the coupling hole 165*a* spaced apart from the coupling ribs 165 to receive the fastener passed through the extension end 124.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A monolithic air conditioner comprising:

a cabinet;

a front panel mounted on a front of the cabinet and including an indoor air intake, an indoor air outlet, and a discharge guide extended from a periphery of the indoor air outlet in a backward direction;

an indoor heat exchanger mounted on a back of the front panel;

an air guide including a front portion on which the indoor heat exchanger is mounted and an orifice defined in a center portion to pass sucked indoor air therethrough;

a scroll mounted on a back of the air guide to guide the sucked indoor air;

an indoor fan mounted between the scroll and the air guide to suck the indoor air;

a shroud mounted on a back of the scroll to guide sucked outdoor air and defining an orifice in a center portion to discharge the sucked outdoor air;

an outdoor fan mounted on a back of the shroud to suck the outdoor air;

a fan motor mounted on the scroll to drive the indoor fan and the outdoor fan; and an outdoor heat exchanger mounted on a back of the outdoor fan to exchange heat with the sucked outdoor air.

2. The monolithic air conditioner according to claim 1, wherein the discharge guide of the front panel includes an upper end and a lower end extended more than the upper end.

3. The monolithic air conditioner according to claim 1, wherein the air guide further includes a discharge guide on an upper portion, the discharge guide having an end abutted against the discharge guide of the front panel to guide discharging of the sucked indoor air.

4. The monolithic air conditioner according to claim 3, wherein both lateral ends of the discharge guide of the air guide are bent upward, and one of the bent lateral ends is divided into an inner guide and an outer guide spaced a predetermined distance apart from the inner guide in an outer direction.

5. The monolithic air conditioner according to claim 1, wherein the air guide further includes at least one heater fixing boss on a front surface.

6. The monolithic air conditioner according to claim 1, wherein the air guide further includes a coupling end extended from a side for coupling with the scroll.

7. The monolithic air conditioner according to claim 1, wherein the air guide further includes a coupling protrusion on a bottom for coupling with the scroll.

8. The monolithic air conditioner according to claim 1, wherein the air guide further includes a leakage preventing rib protruded from a back with a predetermined length to prevent leakage when the indoor air is discharged.

9. The monolithic air conditioner according to claim 1, wherein the scroll includes a discharge guide forwardly extended from a top with a predetermined length to guide discharging of the indoor air.

10. The monolithic air conditioner according to claim 9, wherein both lateral ends of the discharge guide of the scroll are bent downward with a predetermined bent length.

11. The monolithic air conditioner according to claim 1, wherein the scroll includes a shroud coupling end backwardly extended from a top with a predetermined length for coupling with the shroud.

12. The monolithic air conditioner according to claim 1, wherein the scroll includes a control box mounting portion extended from a side with a predetermined length to receive a control box.

13. The monolithic air conditioner according to claim 12, wherein the control box mounting portion includes:

a coupling rib protruded from a front and/or a lateral end of the control box mounting portion for coupling with the control box; and a coupling hole spaced a predetermined distance apart from the coupling rib for receiving a fastener.

14. The monolithic air conditioner according to claim 12, wherein the control box mounting portion includes:

a tube insertion slot defined in an upper end to pass a tube therethrough; and a wire insertion slot to pass a wire extended from the control box therethrough.

15. The monolithic air conditioner according to claim 1, wherein the scroll includes:

a lower extension forwardly extended from a front lower end with a predetermined length to receive the air guide and the indoor heat exchanger;

at least one coupling hole defined in the lower extension; and at least one drain groove defined in the lower extension to drain condensed water.

16. The monolithic air conditioner according to claim 1, wherein the scroll includes:

a motor insertion hole defined in a center portion to receive the fan motor; and at least one motor coupling boss protruded from a back of the scroll around the motor insertion hole.

17. The monolithic air conditioner according to claim 1, wherein the scroll includes a drain guide rib on a side to guide water condensed on a surface of the scroll in a downward direction.

18. The monolithic air conditioner according to claim 17, wherein the drain guide rib of the scroll is sloped down from a rear end to a front end.

19. The monolithic air conditioner according to claim 1, wherein the scroll includes at least one drain hole defined on an upper portion to drain condensed water.

20. The monolithic air conditioner according to claim 1, wherein the shroud includes a cover portion extended from a top to cover the outdoor heat exchanger.

21. The monolithic air conditioner according to claim 20, wherein the shroud further includes a scroll coupling end extended from a front of the cover portion with a predetermined length for coupling with the scroll.

22. The monolithic air conditioner according to claim 1, wherein the fan motor is exposed to the indoor air sucked by the indoor fan.

23. A monolithic air conditioner comprising:

a cabinet;

a front panel mounted on a front of the cabinet, the front panel including an indoor air intake to suck indoor air, an indoor air outlet to discharge the sucked indoor air, and a discharge guide extended from the indoor air outlet in a backward direction;

a heat exchanger assembly installed in the cabinet to allow refrigerant to exchange heat with sucked indoor and outdoor air;

an air guide mounted on a back of the front panel, the air guide including an orifice defined in a center portion to pass the sucked indoor air therethrough and a discharge guide extended from a top to guide discharging of the sucked air;

a scroll mounted on a back of the air guide to guide the sucked indoor air and including a discharge guide forwardly extended from a top to guide discharging of the sucked air;

a shroud mounted on a back of the scroll to guide sucked outdoor air and defining an orifice in a center portion to discharge the sucked outdoor air; and a fan assembly installed in the cabinet to suck the indoor air and the outdoor air, wherein the indoor air exhausted through the indoor air outlet flows along a space surrounded by the discharge guide of the front panel, the air guide and the scroll.

24. The monolithic air conditioner according to claim 23, wherein a lower end of the discharge guide of the front panel and an end of the discharge guide of the air guide are in tight contact with each other.

25. The monolithic air conditioner according to claim 23, wherein lateral and upper ends of the discharge guide of the front panel are in tight contact with an end of the discharge guide of the scroll.

26. The monolithic air conditioner according to claim 23, wherein the air guide and the discharge guide of the scroll include lateral ends bent upward or downward, one of the bent lateral ends of the air guide being divided into an inner guide and an outer guide spaced a predetermined distance apart from the inner guide in a lateral direction, one of the bent lateral ends of the discharge guide of the scroll being inserted between the inner guide and the outer guide.

27. The monolithic air conditioner according to claim 26, wherein the other of the bent lateral ends of the air guide is in tight contact with the other of the bent lateral ends of the discharge guide of the scroll.

28. The monolithic air conditioner according to claim 23, wherein the air guide further includes a coupling end on a lateral back end, and the scroll further includes a coupling hook protruded from a side for coupling with the coupling end of the air guide.

29. The monolithic air conditioner according to claim 23, wherein the scroll further includes a shroud coupling end backwardly extended from a top with a predetermined length, and the shroud includes a scroll coupling end forwardly extended from a top with a predetermined length for coupling with the shroud coupling end of the scroll in a sliding manner.

30. The monolithic air conditioner according to claim 29, wherein the shroud coupling end includes at least one guide slot with a predetermined length and width, and the scroll coupling end includes a slide rib on a bottom for sliding into the guide slot.

31. The monolithic air conditioner according to claim 29, wherein the shroud coupling end of the scroll includes a restricting rib inwardly extended from a lateral end with a predetermined length to restrict overlap length between the shroud coupling end and the scroll coupling end.

32. The monolithic air conditioner according to claim 23, wherein the air guide further include a coupling protrusion on a bottom, and the scroll further includes a coupling hole defined in a lower surface to receive the coupling protrusion when the air guide is seated on the scroll.

* * * * *